US009056514B2

(12) United States Patent
Foster et al.

(10) Patent No.: US 9,056,514 B2
(45) Date of Patent: Jun. 16, 2015

(54) THERMAL CLEAR LAMINATE DONOR ELEMENT

(71) Applicant: KODAK ALARIS INC., Rochester, NY (US)

(72) Inventors: David George Foster, West Henrietta, NY (US); Robert W. Wagner, Hilton, NY (US)

(73) Assignee: Kodak Alaris Inc., Rochester, NY (US)

( * ) Notice: Subject to any disclaimer, the term of this patent is extended or adjusted under 35 U.S.C. 154(b) by 129 days.

(21) Appl. No.: 13/958,675

(22) Filed: Aug. 5, 2013

(65) Prior Publication Data

US 2015/0037520 A1 Feb. 5, 2015

(51) Int. Cl.

*B41M 5/34* (2006.01)
*B41M 5/382* (2006.01)
*B41M 5/392* (2006.01)

(52) U.S. Cl.

CPC ..... *B41M 5/38214* (2013.01); *B41M 5/392* (2013.01); *B41M 5/345* (2013.01); *B41M 2205/40* (2013.01); *B41M 5/38264* (2013.01)

(58) Field of Classification Search

CPC ..... B41M 5/34; B41M 5/345; B41M 5/382; B41M 5/38264; B41M 2205/40
USPC ..... 156/235; 347/171; 428/32.75, 32.76, 428/32.86; 503/227
See application file for complete search history.

(56) References Cited

U.S. PATENT DOCUMENTS

| | | | | |
|---|---|---|---|---|
| 5,397,634 | A | 3/1995 | Cahill et al. | |
| 5,432,145 | A | 7/1995 | Oshima et al. | |
| 5,965,485 | A | 10/1999 | Mizumachi et al. | |
| 6,346,502 | B1 | 2/2002 | Simpson et al. | |
| 6,362,132 | B1 | 3/2002 | Simpson et al. | |
| RE38,496 | E | 4/2004 | Sawamura et al. | |
| 6,786,993 | B2 | 9/2004 | Oshima et al. | |
| 6,855,666 | B2 | 2/2005 | Simpson et al. | |
| 7,018,772 | B2 * | 3/2006 | Simpson et al. | 430/201 |
| 7,056,551 | B2 | 6/2006 | Lobo et al. | |
| 7,217,449 | B2 | 5/2007 | Sato | |
| 7,501,382 | B2 | 3/2009 | Foster et al. | |
| 8,450,242 | B2 | 5/2013 | Majumdar et al. | |
| 2004/0167022 | A1 | 8/2004 | Laney et al. | |
| 2007/0213218 | A1 | 9/2007 | Irita et al. | |
| 2011/0067804 | A1 | 3/2011 | Vreeland | |
| 2013/0181331 | A1 | 7/2013 | Srinivasan et al. | |

FOREIGN PATENT DOCUMENTS

| | | |
|---|---|---|
| EP | 1 147 914 | 10/2001 |
| EP | 1 186 438 | 3/2002 |
| EP | 1 452 336 | 9/2004 |

OTHER PUBLICATIONS

International Search Report and Written Opinion dated Nov. 10, 2014 in corresponding PCT application No. PCT/US2014/048639.

* cited by examiner

*Primary Examiner* — Bruce H Hess
(74) *Attorney, Agent, or Firm* — Hogan Lovells US LLP

(57) ABSTRACT

A thermal transfer donor element has a polymeric support having at least a portion thereof coated with a thermal transferable protective transparent film. This film comprises: (1) a poly(vinyl acetal) in an amount of at least 50-70 weight %, (2) a second polymer, and (3) colloidal silica. In addition, (a) the molecular weight of the second polymer is greater than the molecular weight of the poly(vinyl acetal), (b) the weight ratio of the poly(vinyl acetal) to the second polymer is at least 5:1 and up to and including 12:1, (c) the weight ratio of colloidal silica to the second polymer is at least 1.5:1 and up to and including 3:1, and (d) the amount of colloidal silica is at least 10 weight % and up to and including 20 weight %, based on total thermal transferable protective transparent film dry weight.

17 Claims, No Drawings

THERMAL CLEAR LAMINATE DONOR ELEMENT

FIELD OF THE INVENTION

This invention relates to a thermal transfer donor element that can be used to transfer transparent protective films onto thermal receiver elements using thermal transfer means. This invention also relates to an assembly having the thermal transfer donor element that is arranged in thermal association with a thermal receiver element and to a method for its use.

BACKGROUND OF THE INVENTION

There are many ways of forming an image. For example, images can be formed through thermal transfer of dyes, inkjet applications, electrophotographic reproduction, and silver halide image development.

To form any printed image, the image can be chemically developed from film, or developed from an electronic signal generated from a digital capture device or by scanning a film. For thermal, inkjet, and electrophotographic printing, electronic signals indicating appropriate colors are used to produce cyan, magenta, yellow, and black color signals. These signals are then transmitted to a printer where colored material is transferred to an appropriate receiver element. A color hard copy is thus obtained that corresponds to the original image.

Thermal transfer prints are susceptible to re-transfer of colorants to adjacent surfaces, to discoloration by fingerprints because the colorants remain at the surface of the receiver element, and to scratches during imaging and handling. Heat can be used to drive the colorants deeper into the receiver element. Application of a transparent protective overcoat onto these types of color images is also known, and effectively reduces these problems. The transparent protective overcoat can also provide improved light stability if a UV absorbing compound is incorporated in the formulation.

A clear protective layer can be transferred onto a dye image to give the desired protection and finish. This transparent protective layer can be provided as the sole transferrable material in a thermal transfer donor element, or it can be provided as multiple patches, with or without separate patches containing protective layer that has optimal flash and donor receiver separation during printing and handling of the thermal transfer donor element and the final image print as the protective layer is used to cover the thermal dye images.

The thermal transferable protective laminates currently being used in various thermal products comprise a transparent polymeric layer on a support, which transparent polymeric layer is composed of various components designed to provide needed properties and to solve various problems. One problem encountered with thermal donor elements is known as "flash" in which the protective transparent film to be transferred prematurely separates from the donor ribbon (support), resulting in irregular edges and faults in the resulting thermal dye images. It has been found that this problem can be reduced or eliminated by incorporating particulate materials such as colloidal silica into the protective transparent film.

However, this component is a very expensive material compared to other components of the protective transparent film, for example, polymer or resin binders. Thus, there is a need to find a partial or total replacement of the expensive colloidal silica without experiencing the "flash" problem. The present invention is intended to address this problem.

SUMMARY OF THE INVENTION

To address the "flash" problem described above in a less expensive manner, the present invention provides a thermal transfer donor element comprising a polymeric support having at least a portion thereof coated with a thermal transferable protective transparent film that comprises: (1) a poly (vinyl acetal) in an amount of at least 50 weight % and up to and including 70 weight % based on the total thermal transferable protective transparent film dry weight, (2) a second polymer, and (3) colloidal silica, wherein:

(a) the molecular weight of the second polymer is greater than the molecular weight of the poly(vinyl acetal), (b) the weight ratio of the poly(vinyl acetal) to the second polymer is at least 5:1 and up to and including 12:1, (c) the weight ratio of colloidal silica to the second polymer is at least 1.5:1 and up to and including 3:1, and (d) the amount of colloidal silica is at least 10 weight % and up to and including 20 weight %, based on total thermal transferable protective transparent film dry weight.

Any of the thermal transfer donors of the present invention can be provided in a thermal transfer assembly comprising that thermal transfer donor element that is arranged in thermal association with a thermal dye transfer receiver element.

Moreover, the present invention provides a method for providing a protective overcoat on a thermal dye transfer receiver element comprising:

- bringing any embodiment of thermal transfer donor element of the present invention into thermal association with a thermal receiver element,
- thermally transferring the thermal transferable protective transparent film from the thermal transfer donor element to the thermal receiver element.

In some embodiments, this method of the invention further comprises:

- thermally transferring a dye image from a thermal transfer donor element comprising at least one thermal image dye patch to provide a thermally transferred dye image, and
- thermally transferring the thermal transferable transparent film over the thermally transferred dye image to provide a protective overcoat.

In addition, the present invention provides a protective overcoat on a receiver element comprising:

- bringing any embodiment of the thermal transfer donor element of this invention into thermal association with a thermal receiver element,
- thermally transferring the thermal transferable protective transparent film from the thermal transfer donor element to the thermal receiver element.

The present invention provides thermal transfer donor elements that can be used to provide protective transparent films on thermal transfer receiver elements at less cost. The polymeric formulation used to make up the thermal transferable protective transparent films have been designed with less colloidal silica than has been previously used, but with no loss in properties. In other words, less colloidal silica (perhaps up to 50% less) is needed to control the "flash" problem described above. The colloidal silica has been replaced with particularly designed additive polymers in specifically designed amounts in relation to the primary polymer and the colloidal silica.

DETAILED DESCRIPTION OF THE INVENTION

Definitions

As used herein to define various components of the thermal transferable protective transparent film (and formulation), unless otherwise indicated, the singular forms "a", "an", and "the" are intended to include one or more of the components (that is, including plurality referents).

Each term that is not explicitly defined in the present application is to be understood to have a meaning that is commonly accepted by those skilled in the art. If the construction of a term would render it meaningless or essentially meaningless in its context, the term's definition should be taken from a standard dictionary.

The use of numerical values in the various ranges specified herein, unless otherwise expressly indicated otherwise, are considered to be approximations as though the minimum and maximum values within the stated ranges were both preceded by the word "about". In this manner, slight variations above and below the stated ranges can be used to achieve substantially the same results as the values within the ranges. In addition, the disclosure of these ranges is intended as a continuous range including every value between the minimum and maximum values.

Unless otherwise indicated, the term "weight %" refers to the amount of a component or material based on the total dry weight of the composition, formulation, or layer in which it is located.

Unless otherwise indicated, the terms "thermal transfer donor element" or "donor element" are used herein to refer to embodiments of the present invention. Such donor elements can be used to transfer during the application of thermal energy (or heat) a thermal transferable protective transparent protective film or overcoat (sometimes known in the art as a "laminate"). The same or different donor elements can be used to thermally transfer one or more different dye images.

Unless otherwise indicated, the terms "thermal transferable protective film", "protective overcoat", and "protective clear film" refer to the same feature.

The thermal transfer donor element of this invention comprises a polymeric support (described below) having at least a portion thereof coated with one or more heat transferable materials wherein at least one of those heat transferable materials is the thermally transferable protective transparent film described in more detail below.

Thermal Transfer Donor Elements

Supports:

Any polymeric material can be used as the polymeric support for the thermal transfer donor elements provided it is dimensionally stable and can withstand the heat of thermal transfer, for example from a thermal printing head. Suitable materials can include but are not limited to, polyesters such as poly(ethylene terephthalate) and poly(ethylene naphthalate), polyamides, polycarbonates, glassine paper, condenser paper, cellulose esters such as cellulose acetate, fluorine polymers such as poly(vinylidene fluoride) or poly(tetrafluoroethylene-co-hexafluoropropylene), polyethers such as polyoxymethylene, polyacetals, polyolefins such as polystyrene, polyethylene, polypropylene or methylpentene polymers, and polyimides such as polyimide amides and polyetherimides. The polymeric support can have a thickness of at least 2 μm and up to and including 30 μm, although thicker or thinner supports could be used for specific applications. According to certain embodiments where a high gloss image is desired, the polymeric support can have a surface roughness, Ra, of about 18 nm or less on the side of the polymeric support on which the thermal transferable protective transparent film is provided. The polymeric support can include a black ink or various pigments to provide reflectance or desired tints.

Thermal Transferable Protective Transparent Films:

The thermal transferable protective transparent film can be provided in one or more sections, or patches, on the polymeric support in the thermal transfer donor element, or it can be coated or provided on the entire surface or length (if in the form of a web or ribbon) of polymeric support. The thermal transfer donor element can be provided as individual sheets, rolls, webs, or ribbons of any desired width and length suitable for the intended thermal transfer apparatus. Thus, the resulting protective transparent film can be provided in various sizes and dimensions. The patches or sections of thermal transferable materials on a thermal transfer donor element can be the same or different, and can be in a repeating pattern if desired. For example, typical dye patch colors include yellow, cyan, and magenta, although black, white, metallics (such as aluminum or copper), and secondary and tertiary colors can be also provided in a dye patch, along with the thermal transferable protective transparent film.

Thus, the thermal transfer donor element can include only a thermal transferable protective transparent film, or it can also include one or more thermal transferable dye patches. Thus, a thermal transfer donor element can include one or more desired colored dye patches in a given sequence in combination with a thermal transferable protective transparent film patch (thermal transferable protective clear film), as described below. The sequence of various patches can repeat, if desired, along a web or ribbon. An exemplary sequence commonly used in thermal dye transfer printing is a repeat of black, yellow, magenta, and cyan dye patches, and thermal transferable protective transparent film patch. In many embodiments, the donor element comprises a poly(ethylene terephthalate) support that is coated with one or more patches or a continuous ribbon of the thermal transferable protective transparent film described for this invention.

The thermal transferable protective transparent film disposed on the support of the thermal transfer donor element comprises only three essential components in order to provide the desired protective transparent film after thermal transfer. One essential component is a primary resin that is a poly(vinyl acetal) that is present in an amount of at least 50 weight % and up to and including 70 weight %, or more typically at least 60 weight % and up to and including 70 weight %, based on the total thermal transferable protective transparent film dry weight. Such poly(vinyl acetal) resins can be purchased from several commercial sources and they generally have a molecular weight of at least $0.5\times10^4$ g/mol and up to and including $15.0\times10^4$ g/mol. Mixtures of such poly(vinyl acetal) resins can be used as the primary resin. A particularly useful poly(vinyl acetal) is commercially available as KS-10 from Sekisui (Japan).

A second essential component is a second polymer that is different than the poly(vinyl acetal) at least in molecular weight, and possible also in composition. In particular, the second polymer has a molecular weight that is greater than the molecular weight of the poly(vinyl acetal) by at least one and a half times, or at least 2:1 and up to and including 6:1. Such second polymers then have a molecular weight of up to and including $15.0\times10^4$ g/mol. Examples of useful second polymers include but are not limited to poly(vinyl acetal) resins and cellulose acetate propionate. Such second polymers can also be used in mixtures and they are generally available from various commercial sources. Representative commercial second polymers include but are not limited to, CAP-482-20 cellulose acetate propionate (Eastman Chemical Company), and KS-3 and KS-5 poly(vinyl acetal) resins (Sekisui, Japan).

The second polymer is generally present in the thermal transferable protective transparent film in a specific amount in relation to the dry amount of the primary poly(vinyl acetal). Thus, the dry weight ratio of the primary poly(vinyl acetal) to the second polymer is at least 5:1 and up to and including 12:1, or typically at least 6:1 and up to and including 10:1. In many embodiments, the one or more second polymers can be present in an amount of at least 6 weight % and up to and including 12 weight %, based on the total thermal transferable protective transparent film dry weight.

The third essential component of the thermal transferable protective transparent film is colloidal silica in an amount of at least 12 weight % and up to and including 18 weight %, or typically of at least 12 weight % and up to and including 16 weight %, based on total thermal transferable protective transparent film dry weight. In addition, the dry weight ratio of the colloidal silica to the second polymer is at least 1.5:1 and up to and including 3:1, or typically at least 1.5:1 and up to and including 2.5:1. Such materials can be obtained from various commercial sources, for example as IPA-ST (30% solids in isopropanol).

In the thermal transfer donor element of this invention that comprises a thermal transferable protective transparent film, the amount of colorants in this film is such that the optical density difference when the colorant is present and when the colorant is absent is less than 0.01.

Moreover, the thermal transferable protective transparent film further comprises: (a) an UV-absorbing light stabilizer that is a hydroxyphenyl triazine, (b) a plasticizer, (c) a surfactant, or (d) any combination of (a) through (c). Such materials are well known in this art and there is no need to provide lengthy lists of representative compounds, or the amounts in which they are commonly used.

Still other optional addenda that can be incorporated in the thermal transferable protective clear film include antistatic agents, release agents, defoamers, coating aids, charge control agents, thickeners or viscosity modifiers, antiblocking agents, coalescing aids, crosslinking agents or hardeners, soluble or solid particle dyes, adhesion promoting agents, bite solvents or chemical etchants, lubricants, antioxidants, stabilizers, colorants or tints, fillers, and other materials well known in this art, and in known amounts.

The thermal transferable protective transparent film can also include one or more compounds used to provide light stability. Various compounds for this purpose are known in the art including but not limited to, nickel complexes, hindered amine light stabilizers, and N-oxyl radicals derived from hindered amines. Such compounds are described for example in U.S. Pat. No. 4,855,281 (Byers), U.S. Pat. No. 7,301,012 (Fujiwara), and U.S. Pat. No. 7,384,138 (Taguchi), all of which are incorporated herein by reference, as well as U.S. Patent Application Publication 2011/0067804 (Vreeland). The N-oxyl radicals having a molecular weight of 600 or less and defined by Formula III in the noted publication are particularly useful to stabilize transferred cyan dye images. Useful amounts of the light stabilizers are at least 1 $mg/m^2$ and up to and including 35 $mg/m^2$, and the amounts can be the same or different for the various dye patches (described below) as well as the thermal transferable protective transparent films.

The thermal transferable protective transparent films in the thermal transfer donor elements can also include particulate materials in an amount of at least 0.1 weight % based on the layer dry weight. For example the particulate materials can include crosslinked elastomeric organic beads that can have a glass transition temperature ($T_g$) of 45° C. or less. The elastomeric beads can be made from an acrylic polymer or copolymer, such as butyl-, ethyl-, propyl-, hexyl-, 2-ethylhexyl-, 2-chloroethyl-, 4-chlorobutyl- or 2-ethoxyethyl-acrylate or methacrylate, acrylic acid or methacrylic acid, hydroxyethyl acrylate, a styrenic copolymer, such as styrene-butadiene, styrene-acrylonitrile-butadiene, styrene-isoprene, or hydrogenated styrene-butadiene, or mixtures thereof. The elastomeric beads can be crosslinked with various crosslinking agents, which can be part of the elastomeric copolymer, including but not limited to divinylbenzene, ethylene glycol diacrylate, 1,4-cyclohexylene-bis(oxyethyl) dimethacrylate, 1,4-cyclohexylene-bis(oxypropyl) diacrylate, 1,4-cyclohexylene-bis(oxypropyl) dimethacrylate, and ethylene glycol dimethacrylate. The elastomeric beads can have at least 1% and up to and including 40% by weight of a crosslinking agent. The elastomeric microbeads can be used in any amount effective for the intended purpose. In general, good results have been obtained using at least 2 $mg/m^2$ and up to and including 25 $mg/m^2$. The elastomeric microbeads generally have a particle size of at least 4 μm and up to and including 10 μm. The beads should be used at a coverage that is not detrimental to gloss but is beneficial for finishing operations involving web-transport and spool winding.

The elastomeric beads can be crosslinked with various crosslinking agents that can also be part of the elastomeric copolymer, such as divinylbenzene, ethylene glycol diacrylate, 1,4-cyclohexylene-bis(oxyethyl) dimethacrylate, 1,4-cyclohexylene-bis(oxypropyl) diacrylate, 1,4-cyclohexylene-bis(oxypropyl) dimethacrylate, and ethylene glycol diacrylate.

The glass transition temperatures for the elastomeric beads can be determined by the method of differential scanning calorimetry (DSC) at a scanning rate of 20° C./minute and the onset in the change in heat capacity is taken as the $T_g$.

The thermal transferable protective transparent film can also include non-elastomeric beads that can have a particle size of at least 0.5 μm and up to and including 20 μm. These beads can act as spacer beads under the compression force of a wound up dye donor roll, improving raw stock keeping of the dye donor roll by reducing the material transferred from the thermal transfer donor element to a slipping layer on the backside of the same thermal transfer donor element, as measured by the change in sensitometry under accelerated aging conditions or from the backside of the thermal transfer donor element, for example, from a slipping layer, to the front side thermal transferable protective transparent layer. The use of the beads can result in reduced mottle and improved image quality. The beads can be employed in any amount effective for the intended purpose, for example at a coverage of at least 0.003 $g/m^2$ and up to and including 0.20 $g/m^2$.

The thermal transferable protective transparent film can also include a stick preventative agent to reduce or eliminate sticking between the thermal transfer donor element and the thermal dye transfer receiver element during printing. The stick preventative agent can be present in other layers of the thermal transfer donor element, so long as the stick preventative agent is capable of diffusing through the layers to the thermal transferable protective transparent film, or transferring from the slip layer to the thermal transferable protective transparent film. The stick preventative agent can be a silicone- or siloxane-containing polymer. Suitable polymers can include graft copolymers, block polymers, copolymers, and polymer blends or mixtures. Suitable stick preventative agents are described, for example, in U.S. Pat. No. 7,067,457 (Foster et al.) the disclosure of which is incorporated herein by reference.

Useful release agents can include, for example, those described in U.S. Pat. No. 4,740,496 (Vanier) and U.S. Pat. No. 5,763,358 (Kaszczuk et al.) the disclosures of which are incorporated herein by reference.

As noted above, the thermal transferable protective transparent film can be formed or coated onto a support using a suitable formulation. The components of the film described above including any optional additives can be dissolved in a suitable solvent or mixture of solvents for coating purposes. The thermal transferable protective transparent film can be formed or coated on the support by techniques such as, but not limited to, gravure process, spin-coating, solvent-coating, extrusion-coating, spray-coating, or other methods known to practitioners in the coating art.

Optional Layers:

It is also possible that the thermal transfer donor element comprises a subbing layer, for example, an adhesive or antistatic tie layer, a dye-barrier layer, or a combination thereof, which can be coated between the support and the thermal transferable protective transparent film. The subbing layer can comprise one or more layers as described for example in U.S. Pat. No. 4,695,288 (Ducharme) and U.S. Pat. No. 4,737,486 (Kaszczuk et al.) the disclosures of which are incorporated herein by reference.

An adhesive or tie layer can be present to adhere the thermal transferable protective transparent film to the support. Suitable adhesives are known to practitioners in the art, for example, Tyzor TBT® from E.I. DuPont de Nemours and Company. The tie layer can include a hydrophilic polymer.

A slip layer can be provided on the back side of the thermal transfer donor element of the invention (on the support opposite the thermal transferable protective transparent film) to prevent the printing head from sticking to it. Such a slip layer can comprise either a solid or liquid lubricating material or mixtures thereof, with or without a polymeric binder or a surface-active agent. Useful lubricating materials include oils or semi-crystalline organic solids that melt below 100° C. such as poly(vinyl stearate), beeswax, perfluorinated alkyl ester polyethers, poly-caprolactone, silicone oil, poly(tetrafluoroethylene), carbowax, poly(ethylene glycols). Suitable polymeric binders for the slip layer include poly(vinyl alcohol-co-butyral), poly(vinyl alcohol-co-acetal), polystyrene, poly(vinyl acetate), cellulose acetate butyrate, cellulose acetate propionate, cellulose acetate, and ethyl cellulose.

For example, the slip layer formulation can incorporate a synergistic combination of lubricants from a friction perspective and in terms of headwear or print head buildup, as disclosed in U.S. Pat. No. 7,078,366 (Foster et al.) the disclosure of which is incorporated herein by reference. The slip layer can comprise a maleic anhydride polyethylene graft copolymer and at least one other hydrocarbon wax. A lubricating material can comprise a solid polymer derived from a polyolefin and an ethylenically unsaturated carboxylic acid or ester or anhydride thereof, and at least one wax. The polymer can be an α-olefin maleic anhydride copolymer, a maleic anhydride polyethylene graft copolymer, and a copolymer of an α-olefin and isopropyl maleate. The polyolefin is derived from an α-olefin containing between about two to about eight carbon atoms, preferably where the α-olefin is ethylene or propylene, or both. The ethylenically unsaturated carboxylic acids are those having between about 3 and 12 carbon atoms. The ethylenically unsaturated carboxylic acid, ester or anhydride can be, for example, maleic acid, ethylmaleic acid, propylmaleic acid, isopropyl maleic acid, fumaric acid, methylenemalonic acid, glutaconic acid, itaconic acid, methylitaconic acid, mesaconic acid, citraconic acid, or a mixture thereof, as well as corresponding esters, anhydrides or mixtures of such acids, esters and anhydrides. The other wax can be an olefinic wax, a saturated hydrocarbon polymer, a linear low molecular weight polyethylene, a branched hydrocarbon with a number average molecular weight of no more than about 10,000 and a melting point or softening point of no more than about 120° C., or a synthetic wax comprising a saturated or unsaturated hydrocarbon. The other wax can be selected from, for example, a mineral wax, a vegetable wax, an animal wax or a synthetic wax that is a saturated or unsaturated hydrocarbon polymer. The ratio of the first wax to the other wax is generally from 5:1 to 1:10. Typically, the slip layer comprises at least three different waxes, the polymer derived from the polyolefin and the ethylenically unsaturated carboxylic acid or ester or anhydride thereof, a highly branched α-olefin polymer, and at least one other wax. This slip layer formulation for resistive head thermal media incorporates a synergistic combination of lubricants from a friction perspective and in terms of headwear buildup.

The amount of lubricating material used in a slip layer is dependent, at least in part, upon the type of lubricating material, but can be in the range of at least 0.001 g/m$^2$ and up to and including 2 g/m$^2$. If a polymeric binder is used, the lubricating material can be present in a range of at least 0.1 weight % and up to and including 50 weight % of the polymeric binder.

Any binder can also be used in the slip layer provided it will be useful for the intended effect. In some embodiments, polymeric thermoplastic binders are employed, including, for example, poly(styrene-co-acrylonitrile) (70/30 weight ratio), poly(vinyl alcohol-co-butyral) (available commercially as Butvar® 76® from Monsanto Corp.), poly(vinyl alcohol-co-acetal), poly(vinyl alcohol-co-benzal), polystyrene, poly(vinyl acetate), cellulose acetate butyrate, cellulose acetate propionate, cellulose acetate, ethyl cellulose, cellulose triacetate, poly(methyl methacrylate), and copolymers of methyl methacrylate.

Dye-Containing Thermal Transferable Materials

Any ink or dye can be used in a thermal dye transfer donor element that can be used in conjunction with the thermal transfer donor elements of the present invention. Known features of such thermal dye transfer donor elements are described, for example, in U.S. Pat. No. 4,916,112 (Henzel et al.), U.S. Pat. No. 4,927,803 (Bailey et al.), and U.S. Pat. No. 5,023,228 (Hemel) the disclosures of which are all incorporated herein by reference. Forming a dye transfer image generally include imagewise heating a dye-containing heat transferable material to either or both sides of a thermal dye receiver element.

The dye donor layer can include a single color area (patch) or multiple colored areas (patches) containing dyes suitable for thermal printing. As used herein, a "dye" can be one or more dyes, pigments, colorants, or a combination thereof, and can optionally be in a binder or carrier as is known to practitioners in the art. For example, the dye layer can include a magenta dye combination and further comprise a yellow dye-donor patch comprising at least one bis-pyrazolone-methine dye and at least one other pyrazolone-methine dye, and a cyan dye-donor patch comprising at least one indoaniline cyan dye.

Further examples of useful dyes for various color images obtained by thermal transfer can be found in U.S. Pat. No. 4,541,830 (Hotta et al.), U.S. Pat. No. 4,698,651 (Moore et al.), U.S. Pat. No. 4,695,287 (Evans et al.), U.S. Pat. No. 4,701,439 (Evans et al.), U.S. Pat. No. 4,757,046 (Byers et al.), U.S. Pat. No. 4,743,582 (Evans et al.), U.S. Pat. No. 4,769,360 (Evans et al.), U.S. Pat. No. 4,753,922 (Byers et al.), U.S. Pat. No. 4,910,187 (Sato et al.), U.S. Pat. No. 5,026,677 (Vanmaele), U.S. Pat. No. 5,101,035 (Bach et al.), U.S. Pat. No. 5,142,089 (Vanmaele), U.S. Pat. No. 5,374,601 (Takiguchi et al.), U.S. Pat. No. 5,476,943 (Komamura et al.), U.S. Pat. No. 5,532,202 (Yoshida), U.S. Pat. No. 5,804,531 (Evans et al.), U.S. Pat. No. 6,265,345 (Yoshida et al.), and U.S. Pat. No. 7,501,382 (Foster et al.), and U.S. Patent Application Publications 2003/0181331 (Foster et al.) and 2008/0254383 (Soejima et al.), the disclosures of all of which are incorporated herein by reference. Other useful dyes, especially magenta, yellow, and cyan dyes and combinations of two or more of each color dye, are described in U.S. Patent Application Publication 2011/0067804 (Vreeland) the disclosure of which is incorporated herein by reference.

The noted dyes can be employed singly or in combination to obtain a monochrome dye-donor layer or a black dye donor layer. The dyes can be used in an amount of at least 0.05 $g/m^2$ and up to and including 2 $g/m^2$ of coverage but the amounts are not limited to this range.

Each dye donor layer can include one or more dyes at a coverage of at least 20 weight % and up to and including 90 weight % dye, relative to the total dry weight of all components in the dye donor layer. The dye percent is ideally chosen in view of the specific dye thermal donor element and dye thermal receiver element combination. Varying the amount of dye in the dye thermal donor element can aid in matching the efficiency between different dye patches, for example, a cyan, magenta, and yellow patch.

To form each color patch of a dye donor layer, one or more dyes can be dispersed in a non-heat transferable polymeric binder. Such polymeric binders can be used in an amount of at least 0.05 $g/m^2$ and up to and including 5 $g/m^2$. The polymeric binder can be, for example, a polycarbonate, a polyester, a poly(styrene-co-acrylonitrile), a poly(sulfone), a poly(phenylene oxide), a cellulose derivative including but not limited to cellulose acetate, cellulose acetate propionate, cellulose acetate butyrate, or cellulose triacetate, or a combination of these polymers. Typically, the polymeric binder is a cellulose ether or ester, for example, ethyl cellulose.

The dye-containing layers (or patches) can also include one or more compounds used to provide light stability including the compounds described above for the thermal transfer donor elements of this invention. Useful amounts of the light stabilizers are at least 1 $mg/m^2$ and up to and including 35 $mg/m^2$, and the amounts can be the same or different for the various dye patches.

The dye donor layers can also include particulate materials as described above in an amount of at least 0.1 weight % based on the layer dry weight. The dye donor layer can also include non-elastomeric beads that can have a particle size of at least 0.5 μm and up to and including 20 μm as described above.

The dye transfer donor element can also include a stick preventative agent to reduce or eliminate sticking as described above. The stick preventative agent can be present in any layer of the dye transfer donor element, so long as the stick preventative agent is capable of diffusing through the layers of the dye donor element to the dye donor layer, or transferring from the slip layer to the dye donor layer. The stick preventative agent can be in one or more colored patches of the dye donor layer, or a combination thereof. If more than one dye patch is present in the dye donor layer, the stick preventative agent can be present in the last patch of the dye donor layer to be printed, typically the cyan layer. However, the dye patches can be in any order. For example, if repeating patches of cyan, magenta, and yellow are used in the dye transfer donor element, in that respective order, the yellow patches, as the last patches printed in each series, can include the stick preventative agent. The stick preventative agent can be a silicone- or siloxane-containing polymer.

Release agents as known to practitioners in the art can also be added to the dye transfer donor element, for example, to the dye donor layer, the slip layer, or both.

The dye donor layer can be formed or coated on a suitable support as described above to form a dye transfer donor element. The dye donor layer composition containing dye(s), non-heat transferable binder, and optional additives can be dissolved in a solvent for coating purposes, all of which are described above. The dye donor layer can be formed or coated on the support by techniques such as, but not limited to, gravure process, spin-coating, solvent-coating, extrusion-coating, spray-coating, or other methods known to practitioners in the art.

According to various embodiments, a subbing layer, for example, an adhesive or antistatic tie layer, a dye-barrier layer, or a combination thereof, can be coated between the support and the dye donor layer, as described above for the thermal transfer donor element of this invention.

As described above also, a slip layer can be used on the back side of the dye transferable donor element on the support opposite the thermal dye donor layer to prevent the printing head from sticking to it. Useful slip layer compositions are described above.

Thus, as described above, in some embodiments of this invention, the thermal transfer donor element can comprise one or more patches of thermal yellow, cyan, magenta, or black image dyes dispersed within a polymeric binder, which patches are arranged in a different location than the thermal transferable protective transparent film.

Thermal Dye Receiver Elements

A thermal dye receiver element that can be used in a thermal transfer assembly with a thermal transfer donor element of the present invention usually comprises a support having thereon a dye image receiving layer. The support for the dye image receiving layer can be transparent or reflective. The support can be a transparent film such as a poly(ether sulfone), a polyimide, a cellulose ester such as cellulose acetate, a poly(vinyl alcohol-co-acetal), or a poly(ethylene terephthalate). Opaque reflective supports can include plain paper, coated paper, synthetic paper, photographic paper support, melt-extrusion-coated paper, and laminated paper, such as biaxially oriented support laminates. Biaxially oriented support laminates suitable for use as receivers are described for example in U.S. Pat. No. 5,853,965 (Haydock et al.), U.S. Pat. No. 5,866,282 (Bourdelais et al.), U.S. Pat. No. 5,874,205 (Bourdelais et al.), U.S. Pat. No. 5,888,643 (Aylward et al.), U.S. Pat. No. 5,888,681 (Gula et al.), U.S. Pat. No. 5,888,683 (Gula et al.), and U.S. Pat. No. 5,888,714 (Bourdelais et al.), the disclosures of all of which are incorporated herein by reference. Biaxially oriented supports can include a paper base and a biaxially oriented polyolefin sheet, for example, polypropylene, laminated to one or both sides of the paper base. The support can be a baryta-coated paper, white polyester (polyester with white pigment incorporated therein), an ivory paper, a condenser paper, or a synthetic paper, for example, DuPont Tyvek® by E.I. DuPont de Nemours and Company (Wilmington, Del.). The support can be used at any desired thickness, for example, at least 10 μm and up to and including 1000 μm. Exemplary supports for the dye image-receiving layer are disclosed in U.S. Pat. No. 5,244,861 (Campbell et al.) and U.S. Pat. No. 5,928,990 (Guistina et al.) and EP 671,281 (Campbell et al.), all of which are incorporated herein by reference. The support can be a composite or laminate structure comprising a base layer and one or more additional layers. The base layer can comprise more than one material, for example, a combination of one or more of a microvoided layer, a foamed layer, a layer with hollow particles, a non-voided layer, a synthetic paper, a natural paper, and a polymer.

The dye image-receiving layer can comprise, for example, a polycarbonate, a polyurethane, a polyester, poly(styrene-co-acrylonitrile), poly(caprolactone), vinyl-series resins, such as halogenated polymers (for example, polyvinyl chloride and poly(vinylidene chloride)), polyvinyl acetate), ethylene-vinyl acetate copolymer, vinyl chloride-vinyl acetate copolymer, or mixtures thereof. Latex polymers can be used in the dye image-receiving layer. The latex polymer can be a dispersion in which hydrophobic polymers comprising a monomer unit of, for example, water-insoluble vinyl chloride dispersed as fine particles in a water-soluble dispersion medium. The dispersed state can be one in which polymer is emulsified in a dispersion medium, one in which polymer underwent emulsion polymerization, one in which polymer underwent micelle dispersion, one in which polymer molecules partially have a hydrophilic structure. For such latex polymers it is desirable to prepare the dye image-receiving layer by applying an aqueous type coating solution and then drying it. Exemplary aqueous coating formulations are disclosed for example in U.S. Patent Application Publication 2008/0254241 (Haraguchi et al.) the disclosure of which is incorporated herein by reference. The dye image-receiving layer can be present in any amount that is effective for the intended purpose. In general, good results can be obtained at a concentration of at least 1 $g/m^2$ and up to and including 5 $g/m^2$. Details of useful polymers and supports for the dye image-receiving element are provided for example in U.S. Pat. No. 7,514,028 (Kung et al.) the disclosure of which is incorporated herein by reference.

The dye image-receiving layer generally can include one or more plasticizers in an amount of up to 50 weight % based on total layer polymer weight. Generally, the amount of plasticizer is at least 4 weight % and up to and including 30 weight % based on the total layer polymer weight. Useful plasticizers include but are not limited to, aliphatic esters such as monomeric and polymeric esters such as ditridecyl phthalate, dicyclohexyl phthalate, dioctylsebacate, polycaprolactone, poly (butylene adipate), and poly(hexamethylene sebacate), as well as others described in U.S. Pat. No. 4,871,715 (Harrison et al.) and U.S. Pat. No. 6,291,396 (Bodem et al.) the disclosures of which are incorporated herein by reference.

Other optional additives in the dye image-receiving layer include stabilizers such as phosphorus-containing stabilizers (for example, phosphorous acid, an organic diphosphite, a phosphate, an alkyl phosphate, an aryl phosphate, an inorganic phosphate, a phosphoric acid ester, and a phosphorous acid ester) and dialkyl esters (such as dioctyl sebacate) or combinations thereof, release agents such as a modified polydimethylsiloxane, and a-tocophenol or derivatives thereof, as described for example in U.S. Pat. No. 7,514,028 (Kung et al.) the disclosure of which is incorporated herein by reference. Other release agents include silicone or fluorine based compounds as disclosed, for example, in U.S. Pat. No. 4,820,687 (Kawasaki et al.) and U.S. Pat. No. 4,695,286 (Vanier et al.), the disclosures of which are incorporated herein by reference.

Additional polymeric layers can be present between the support and the dye image-receiving layer. The additional layers can provide coloring, adhesion, antistatic properties, act as a dye-barrier, act as a dye mordant layer, or a combination thereof. For example, a polyolefin such as polyethylene or polypropylene can be present. White pigments such as titanium dioxide or zinc oxide can be added to the polymeric layer to provide reflectivity.

A subbing layer can be used over the polymeric layer in order to improve adhesion to the dye image-receiving layer. This can be an adhesive or tie layer. Exemplary subbing layers are disclosed in U.S. Pat. No. 4,748,150 (Vanier et al.), U.S. Pat. No. 4,965,238 (Henzel), U.S. Pat. No. 4,965,239 (Henzel), and U.S. Pat. No. 4,965,241 (Henzel et al.) the disclosure of all of which are incorporated herein by reference. An antistatic layer as known to practitioners in the art can also be used in the thermal dye receiver element. The thermal dye receiver element can also include a backing layer. Suitable examples of backing layers include those disclosed in U.S. Pat. No. 5,011,814 (Harrison) and U.S. Pat. No. 5,096,875 (Martin) the disclosures of which are incorporated herein by reference.

The dye image-receiver element can also include stick preventative agents, as described for the dye transfer donor elements.

The dye image-receiving layer can be formed on the support by any method known to practitioners in the art, including but not limited to printing, solution coating, dip coating, and extrusion coating. When the dye image-receiving layer is extruded, the process can include (a) forming a melt comprising a thermoplastic material, (b) extruding or co-extruding the melt as a single-layer film or a layer of a composite (multilayer or laminate) film, and (c) applying the extruded film to the support for the receiver element. Exemplary extruded receiving layer formats are disclosed in U.S. Pat. No. 7,125,611 (Kung et al.), U.S. Pat. No. 7,091,157 (Kung), U.S. Pat. No. 7,005,406 (Kung et al.), U.S. Pat. No. 6,893,592 (Arrington et al.), and U.S. Pat. No. 6,897,183 (Arrington et al.), the disclosures of which are incorporated by reference.

Imaging and Thermal Transfer Assemblies

Thermal printing heads, which can be used to transfer dye or the thermal transferable protective transparent film from either a dye donor element or a thermal transfer donor element of the invention, are available commercially. Representative examples include, for example, a Fujitsu Thermal Head FTP-040 MCSOO1, a TDK Thermal Head LV5416, or a Rohm Thermal Head KE 2008-F3.

A thermal dye transfer assembly of the invention comprises (a) a thermal transfer donor element of this invention as described above, and (b) a thermal receiver element (that can be a thermal dye transfer receiver element) as described above, the two elements being in a superposed relationship so that the thermal transferable protective transparent film of the thermal transfer donor element is in contact with the receiving layer of the thermal receiver element.

The thermal transfer donor element used in this thermal transfer assembly can further comprise one or more patches of thermal yellow, cyan, magenta, or black image dyes dispersed within a polymeric binder, which patches are arranged in a different location from the thermal transferable protective transparent film that provides a protective laminate in the thermal dye transfer receiver element.

The assembly comprising these two elements can be preassembled as an integral unit when a monochrome image is to be obtained. This can be done by temporarily adhering the two elements together at their margins. After transfer, the two elements can be then peeled apart to reveal a transferred dye image and a transferred protective clear film (or laminate).

When a three-color image and a protective clear film are to be formed by thermal transfer, the assembly is generally formed on at least four occasions during the time when heat is applied by the thermal printing head. After the transfer is made, the elements are peeled apart. A donor element (or another area of the donor element with a different dye patch) is then brought in register with the thermal receiver element and the process is repeated. The remaining color and the protective clear film are applied in the same manner with the protective clear film (laminate) on top over all dye images.

The thermally transferable protective transparent film can be thermally transferred over the thermally transferred dye image(s) using an imaging laser. Thus, the method of this invention can provide a multicolor thermal dye print having a protective transparent overcoat disposed over the multicolor thermal dye image wherein the protective transparent overcoat is provided from the thermal transferable protective transparent film described herein.

In some embodiments, the method of this invention can be carried out using a thermal printer having one or two thermal print heads for thermal transfer of a dye image, a thermally transferable protective transparent film, or a metal pattern or layer, or any combination thereof, and the thermal printer optionally comprises a rotatable carousel for moving the thermal transfer donor element in relation to the one or more thermal print heads. Thus, the thermal printer can be designed to provide any of these transferred materials on one or both sides of a thermal receiver element support (or substrate).

When the thermal transferable protective transparent film is applied, it can be patterned to provide a matte or glossy finish by varying thickness, line time, print energy, or some combination thereof. Further, expandable or pre-expanded beads can be used in the thermal transferable protective transparent film to affect a gloss or matte finish depending on the amount and size of the beads. These thermal transferable protective transparent films, whether patterned or not, can be provided over any dye image or metal layer or pattern disposed on, for example but not limited to, ink jet, thermal, or electrophotographic receivers, or silver halide prints.

The present invention provides at least the following embodiments and combinations thereof, but other combinations of features are considered to be within the present invention as a skilled artisan would appreciate from the teaching of this disclosure:

1. A thermal transfer donor element comprising a polymeric support having at least a portion thereof coated with a thermal transferable protective transparent film that comprises: (1) a poly(vinyl acetal) in an amount of at least 50 weight % and up to and including 70 weight % based on the total thermal transferable protective transparent film dry weight, (2) a second polymer, and (3) colloidal silica, wherein:

(a) the molecular weight of the second polymer is greater than the molecular weight of the poly(vinyl acetal), (b) the weight ratio of the poly(vinyl acetal) to the second polymer is at least 5:1 and up to and including 12:1, (c) the weight ratio of colloidal silica to the second polymer is at least 1.5:1 and up to and including 3:1, and (d) the amount of colloidal silica is at least 10 weight % and up to and including 20 weight %, based on total thermal transferable protective transparent film dry weight.

2. The thermal transfer donor element of embodiment 1, wherein the second polymer is a poly(vinyl acetal) or a cellulose acetate propionate.

3. The thermal transfer donor element of embodiment 1 or 2, wherein the molecular weight of the second polymer is greater than the molecular weight of the poly(vinyl acetal) by at least 2:1 and up to and including 6:1.

4. The thermal transfer donor element of any of embodiments 1 to 3, wherein the second polymer is cellulose acetate propionate.

5. The thermal transfer donor element of any of embodiments 1 to 4, wherein the amount of colloidal silica is at least 12 weight % and up to and including 18 weight %, based on total thermal transferable protective transparent film dry weight.

6. The thermal transfer donor element of any of embodiments 1 to 5, wherein the amount of the second polymer is at least 6 weight % and up to and including 12 weight %, based on total thermal transferable protective transparent film dry weight.

7. The thermal transfer donor element of any of embodiments 1 to 6, wherein the thermal transferable protective transparent film further comprises an UV-absorbing light stabilizer that is a hydroxyphenyl triazine or an N-oxyl radical that is derived from a hindered amine.

8. The thermal transfer donor element of any of embodiments 1 to 7, further comprising one or more patches of thermal yellow, cyan, magenta, or black image dyes dispersed within a polymeric binder, which patches are arranged in a different location than the thermal transferable protective transparent film.

9. The thermal transfer donor element of any of embodiments 1 to 8 that further comprises a slip layer on the polymeric support opposite the thermal transferable protective transparent film.

10. A thermal transfer assembly comprising the thermal transfer donor element of any of embodiments 1 to 9 that is arranged in thermal association with a thermal receiver element.

11. The thermal transfer assembly of embodiment 10, wherein the thermal transfer donor element further comprises one or more patches of thermal yellow, cyan, magenta, or black image dyes dispersed within a polymeric binder, which patches are arranged in a different location from the thermal transferable protective transparent film.

12. A method for providing a protective overcoat on a thermal dye transfer receiver element comprising:

bringing the thermal transfer donor element of any of embodiments 1 to 9 into thermal association with a thermal receiver element, thermally transferring the thermal transferable protective transparent film from the thermal transfer donor element to the thermal receiver element.

13. The method of embodiment 12 further comprising:

thermally transferring a dye image from a thermal transfer donor element comprising at least one thermal image dye patch to provide a thermally transferred dye image, and thermally transferring the thermal transferable transparent film over the thermally transferred dye image to provide a protective overcoat.

14. The method of embodiment 13 that is carried out in a thermal printer having one or two thermal print heads for thermal transfer of a dye image, a thermally transferable transparent film, or a metal pattern or layer, or any combination thereof, and the thermal printer optionally comprises a rotatable carousel for moving the thermal transfer donor element in relation to the one or more thermal print heads.

15. The method of any of embodiments 13 to 14 for providing a multicolor thermal dye print having a protective transparent overcoat disposed over the multicolor thermal dye image, the protective overcoat being provided from the thermal transferable clear film.

16. A method for providing a protective overcoat on a receiver element comprising:

bringing the thermal transfer donor element of any of embodiments 1 to 9 into thermal association with a thermal receiver element, thermally transferring the thermal transferable protective transparent film from the thermal transfer donor element to the thermal receiver element.

17. The method of embodiment 16, wherein the thermal receiver element is a thermal dye transfer receiver element.

The following Examples are provided to illustrate the practice of this invention and are not meant to be limiting in any manner.

The following materials were used in the Examples:

Poly(vinyl acetal) resins KS-1, KS-3, KS-5, KS-10, BX-1, and BX-L were obtained from Sekisui (Japan).

CAP-482-20 is a cellulose acetate propionate that was obtained from Eastman Chemical Company (Tennessee, USA).

Colloidal silica dispersed in isopropanol is commercially available from Nissan Chemicals as IPA-ST.

DEK refers to diethylene ketone.

IPA refers to isopropyl alcohol.

"Dz100" refers to poly(divinyl benzene) beads (about 4 μm average diameter).

The UV light absorber of the hydroxyphenyl-triazine class commercially is available from CIBA as Tinuvin® 460.

Invention and Comparative Examples

The thermal transfer donor elements prepared and evaluated comprised a 4.5 μm thick polyethylene terephthalate (PET) support that had been previously coated on one side with a subbing layer of titanium alkoxide and a silicone-free slipping layer as described in U.S. Pat. No. 7,501,382 B2 (Foster et al., slip layer in Invention Example 2, Col. 32, lines 37-62). A number of thermal transferable protective transparent film formulations were prepared with the materials described below in TABLE I and coated on a sample of the support (on the side opposite the slipping layer) by a direct gravure method at a 61 m/min coating speed and dried at 82° C. to provide a dry coating of 25 mg/ft$^2$. Each formulation was coated out of a 50:50 weight ratio of DEK and toluene.

Each of these coatings was thermally transferred as a thermally transferable protective transparent film to a $D_{max}$ print to provide a protective transparent overcoat, which was evaluated (as described below).

TABLE I

Dry laydown in mg/ft$^2$ except for organic solvents

| | Comparative Example 1 | Comparative Example 2 | Invention Example 1 | Invention Example 2 | Invention Example 3 | Invention Example 4 | Invention Example 5 |
|---|---|---|---|---|---|---|---|
| KS-10 poly(vinyl acetal) | 56.42 | 56.42 | 56.42 | 56.42 | 56.42 | 56.42 | 56.42 |
| Dz100 | 2.85 | 2.85 | 2.85 | 2.85 | 2.85 | 2.85 | 2.85 |
| IPA-ST (30% in IPA) | 25.00 | 25.00 | 12.50 | 12.5 | 12.5 | 12.5 | 12.5 |
| Tinuvin ® 460 | 9.57 | 9.57 | 9.57 | 9.57 | 9.57 | 9.57 | 9.57 |
| Additive polymer | 0 | 20** | 5* | 10* | 15* | 20* | 25* |

| | Invention Example 6 | Invention Example 7 | Invention Example 8 | Invention Example 9 | Invention Example 10 | Invention Example 11 | Invention Example 12 |
|---|---|---|---|---|---|---|---|
| KS-10 poly(vinyl acetal) | 56.42 | 56.42 | 56.42 | 56.42 | 56.42 | 56.42 | 56.42 |
| Dz100 | 2.85 | 2.85 | 2.85 | 2.85 | 2.85 | 2.85 | 2.85 |
| IPA-ST (30% in IPA) | 12.50 | 12.50 | 12.50 | 12.50 | 12.50 | 12.50 | 12.50 |
| Tinuvin ® 460 | 9.57 | 9.57 | 9.57 | 9.57 | 9.57 | 9.57 | 9.57 |
| Additive polymer | 5** | 10** | 15** | 10*** | 15*** | 20*** | 25*** |

| | Comparative Example 3 | Comparative Example 4 | Invention Example 13 | Comparative Example 5 | Comparative Example 6 | Comparative Example 7 | Invention Example 14 |
|---|---|---|---|---|---|---|---|
| KS-10 poly(vinyl acetal) | 56.42 | 56.42 | 56.42 | 56.42 | 56.42 | 56.42 | 56.42 |
| Dz100 | 2.85 | 2.85 | 2.85 | 2.85 | 2.85 | 2.85 | 2.85 |
| IPA-ST (30% in IPA) | 12.5 | 12.5 | 12.5 | 12.5 | 12.5 | 12.5 | 12.5 |
| Tinuvin ® 460 | 9.57 | 9.57 | 9.57 | 9.57 | 9.57 | 9.57 | 9.57 |
| Additive polymer | 25** | 5*** | 10$ | 5$ | 15$ | 5$$ | 15$$ |

| | Comparative Example 8 | Comparative Example 9 | Comparative Example 10 | Comparative Example 11 |
|---|---|---|---|---|
| KS-10 poly(vinyl acetal) | 56.42 | 56.42 | 56.42 | 56.42 |
| Dz100 | 2.85 | 2.85 | 2.85 | 2.85 |
| IPA-ST (30% in IPA) | 12.5 | 12.5 | 12.5 | 0 |
| Tinuvin ® 460 | 9.57 | 9.57 | 9.57 | 9.57 |
| Additive Polymer | 10$$ | 5$$$ | 10$$$ | 0 |

*CAP-482-20

**KS-1

***BX-L $KS-3

$$KS-5

$$$BX-1

$D_{max}$ prints were created in a mechanized version of the Kodak® Photo Printer 6850 using commercially available thermal dye transfer receiving paper Kodak XtraLife® paper and thermal dye donor ribbon Kodak Professional EKTATHERM® ribbon (catalogue number 106-7347), patchwise thermally coated with cyan, magenta, and yellow dyes in a cellulose acetate propionate binder. After thermally transferring the dyes from the dye donor ribbon to the thermal dye transfer receiving paper, each $D_{max}$ print was further provided with a protective overcoat by thermally transferring each clear film of the Invention and Comparative Examples.

The "flash" evaluation results are shown in the following TABLE II with the evaluation of "0" meaning absolutely no flash observed, an evaluation of "1" meaning that some minor flash was observed, and an evaluation of "2" meaning that severe (unacceptable) flash was observed.

TABLE II

| Example | $D_{max}$ Flash LE and Trail Edge | $D_{max}$ Flash Side Edge | $D_{min}$ Flash LE and Trail Edge | $D_{min}$ Flash Side Edge |
|---|---|---|---|---|
| Comparative 1 | 0 | 0 | 0 | 0 |
| Invention 1 | 0 | 0 | 0 | 0 |
| Invention 2 | 0 | 0 | 0 | 0 |
| Invention 3 | 0 | 0 | 0 | 0 |
| Invention 4 | 0 | 0 | 0 | 0 |
| Invention 5 | 0 | 0 | 0 | 0 |
| Invention 6 | 0 | 0 | 0 | 0 |
| Invention 7 | 0 | 1 | 0 | 0 |
| Invention 8 | 0 | 1 | 0 | 1 |
| Comparative 2 | 0 | 2 | 0 | 1 |
| Comparative 3 | 0 | 2 | 0 | 2 |
| Comparative 4 | 0 | 1 | 0 | 2 |
| Invention 9 | 0 | 1 | 0 | 1 |
| Invention 10 | 0 | 1 | 0 | 1 |
| Invention 11 | 0 | 1 | 0 | 1 |
| Invention 12 | 0 | 1 | 0 | 1 |
| Comparative 5 | 0 | 2 | 0 | 2 |
| Invention 13 | 0 | 0 | 0 | 0 |
| Comparative 6 | 0 | 2 | 0 | 2 |
| Comparative 7 | 0 | 2 | 0 | 1 |
| Comparative 8 | 0 | 2 | 0 | 2 |
| Invention 14 | 0 | 0 | 0 | 0 |
| Comparative 9 | 0 | 1 | 0 | 2 |
| Comparative 10 | 2 | 2 | 0 | 2 |
| Comparative 11 | 2 | 2 | 2 | 2 |

The invention has been described in detail with particular reference to certain preferred embodiments thereof, but it will be understood that variations and modifications can be effected within the spirit and scope of the invention.

The invention claimed is:

1. A thermal transfer donor element comprising a polymeric support having at least a portion thereof coated with a thermal transferable protective transparent film that comprises: (1) a poly(vinyl acetal) in an amount of at least 50 weight % and up to and including 70 weight % based on the total thermal transferable protective transparent film dry weight, (2) a second polymer, and (3) colloidal silica, wherein:

(a) the molecular weight of the second polymer is greater than the molecular weight of the poly(vinyl acetal), (b) the weight ratio of the poly(vinyl acetal) to the second polymer is at least 5:1 and up to and including 12:1, (c) the weight ratio of colloidal silica to the second polymer is at least 1.5:1 and up to and including 3:1, and (d) the amount of colloidal silica is at least 10 weight % and up to and including 20 weight %, based on total thermal transferable protective transparent film dry weight.

2. The thermal transfer donor element of claim 1, wherein the second polymer is a poly(vinyl acetal) or a cellulose acetate propionate.

3. The thermal transfer donor element of claim 1, wherein the molecular weight of the second polymer is greater than the molecular weight of the poly(vinyl acetal) by at least 2:1 and up to and including 6:1.

4. The thermal transfer donor element of claim 1, wherein the second polymer is cellulose acetate propionate.

5. The thermal transfer donor element of claim 1, wherein the amount of colloidal silica is at least 12 weight % and up to and including 18 weight %, based on total thermal transferable protective transparent film dry weight.

6. The thermal transfer donor element of claim 1, wherein the amount of the second polymer is at least 6 weight % and up to and including 12 weight %, based on total thermal transferable protective transparent film dry weight.

7. The thermal transfer donor element of claim 1, wherein the thermal transferable protective transparent film further comprises an UV-absorbing light stabilizer that is a hydroxyphenyl triazine or an N-oxyl radical that is derived from a hindered amine.

8. The thermal transfer donor element of claim 1, further comprising one or more patches of thermal yellow, cyan, magenta, or black image dyes dispersed within a polymeric binder, which patches are arranged in a different location than the thermal transferable protective transparent film.

9. The thermal transfer donor element of claim 1 that further comprises a slip layer on the polymeric support opposite the thermal transferable protective transparent film.

10. A thermal transfer assembly comprising the thermal transfer donor element of claim 1 that is arranged in thermal association with a thermal receiver element.

11. The thermal transfer assembly of claim 10, wherein the thermal transfer donor element further comprises one or more patches of thermal yellow, cyan, magenta, or black image dyes dispersed within a polymeric binder, which patches are arranged in a different location from the thermal transferable protective transparent film.

12. A method for providing a protective overcoat on a thermal dye transfer receiver element comprising:

bringing the thermal transfer donor element of claim 1 into thermal association with a thermal receiver element, thermally transferring the thermal transferable protective transparent film from the thermal transfer donor element to the thermal receiver element.

13. The method of claim 12 further comprising:

thermally transferring a dye image from a thermal transfer donor element comprising at least one thermal image dye patch to provide a thermally transferred dye image, and thermally transferring the thermal transferable transparent film over the thermally transferred dye image to provide a protective overcoat.

14. The method of claim 13 that is carried out in a thermal printer having one or two thermal print heads for thermal transfer of a dye image, a thermally transferable transparent film, or a metal pattern or layer, or any combination thereof, and the thermal printer optionally comprises a rotatable carousel for moving the thermal transfer donor element in relation to the one or more thermal print heads.

15. The method of claim 13 for providing a multicolor thermal dye print having a protective transparent overcoat disposed over the multicolor thermal dye image, the protective overcoat being provided from the thermal transferable clear film.

16. A method for providing a protective overcoat on a receiver element comprising:

bringing the thermal transfer donor element of claim 1 into thermal association with a thermal receiver element, thermally transferring the thermal transferable protective transparent film from the thermal transfer donor element to the thermal receiver element.

17. The method of claim 16, wherein the thermal receiver element is a thermal dye transfer receiver element.

* * * * *